US010431961B2

(12) United States Patent
Takeda et al.

(10) Patent No.: US 10,431,961 B2
(45) Date of Patent: Oct. 1, 2019

(54) SPARK PLUG

(71) Applicant: NGK SPARK PLUG CO., LTD., Nagoya-shi, Aichi (JP)

(72) Inventors: Yohei Takeda, Komaki (JP); Hironori Uegaki, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/318,235

(22) PCT Filed: May 29, 2017

(86) PCT No.: PCT/JP2017/019934
§ 371 (c)(1),
(2) Date: Jan. 16, 2019

(87) PCT Pub. No.: WO2018/029942
PCT Pub. Date: Feb. 15, 2018

(65) Prior Publication Data

US 2019/0173266 A1 Jun. 6, 2019

(30) Foreign Application Priority Data

Aug. 11, 2016 (JP) ..... 2016-158322

(51) Int. Cl.
*H01T 13/34* (2006.01)
*H01T 13/36* (2006.01)
(Continued)

(52) U.S. Cl.
CPC ..... *H01T 13/34* (2013.01); *H01T 13/36* (2013.01); *H01T 13/39* (2013.01); *H01T 21/02* (2013.01)

(58) Field of Classification Search
CPC ..... H01T 13/34; H01T 13/36; H01T 13/39; H01T 13/04–05; H01T 21/02
See application file for complete search history.

(56) References Cited

U.S. PATENT DOCUMENTS 3,909,459 A * 9/1975 Friese ..... H01T 13/39 252/506
3,967,230 A * 6/1976 Kamigaito ..... H01T 13/34 338/66

(Continued)

FOREIGN PATENT DOCUMENTS

JP S51-046628 A 4/1976
JP 2003-022886 A 1/2003
JP 2017-010741 A 1/2017

OTHER PUBLICATIONS

International Search Report from corresponding International Patent Application No. PCT/JP17/19934, dated Jun. 20, 2017.

(Continued)

*Primary Examiner* — Mariceli Santiago
(74) *Attorney, Agent, or Firm* — Kusner & Jaffe

(57) ABSTRACT

A spark plug includes: an insulator having an axial hole formed therein in an axial direction; a center electrode extending in the axial direction and having a rear end located within the axial hole; a metal terminal extending in the axial direction and having a front end located rearward of the rear end of the center electrode within the axial hole; a resistor arranged between the center electrode and the metal terminal within the axial hole; and a conductive seal layer that fills a space between the resistor and the center electrode in the axial. The conductive seal layer has a first layer portion located adjacent to the center electrode and a second layer portion located between the first layer portion and the resistor. The second layer portion has a thermal expansion coefficient different from and falling between those of the first layer portion and the resistor.

8 Claims, 5 Drawing Sheets

(51) Int. Cl.
*H01T 13/39* (2006.01)
*H01T 21/02* (2006.01)

(56) References Cited

U.S. PATENT DOCUMENTS

| | | | | |
|---|---|---|---|---|
| 4,004,183 | A * | 1/1977 | Oki | H01T 13/41 174/152 S |
| 6,380,664 | B1 * | 4/2002 | Pollner | H01T 13/41 313/118 |
| 10,090,646 | B2 * | 10/2018 | Takaoka | H01T 13/05 |
| 10,205,305 | B2 * | 2/2019 | Uegaki | H01T 13/20 |
| 2003/0030355 | A1 | 2/2003 | Honda | |
| 2015/0214697 | A1 * | 7/2015 | Yoshida | H01T 13/20 315/59 |
| 2016/0043531 | A1 * | 2/2016 | Firstenberg | H01T 13/08 313/145 |
| 2018/0175592 | A1 | 6/2018 | Uegaki et al. | |

OTHER PUBLICATIONS

Office Action issued in corresponding Japanese Patent Application No. 2016-158322, dated Apr. 11, 2018 (English machine translation provided).

* cited by examiner

EMBODIMENT

FIG.4(A)
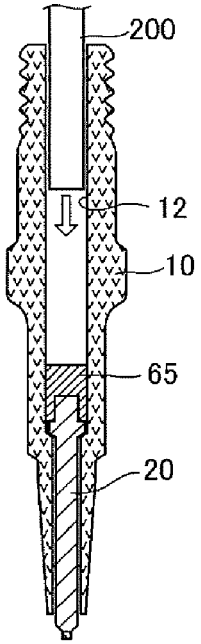
FIG.4(B)
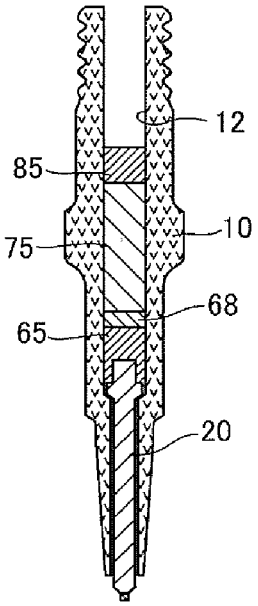
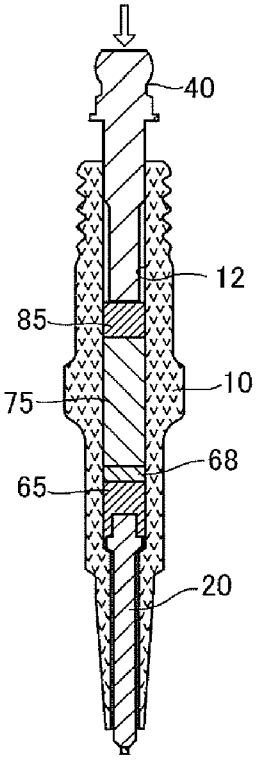
FIG.4(C)
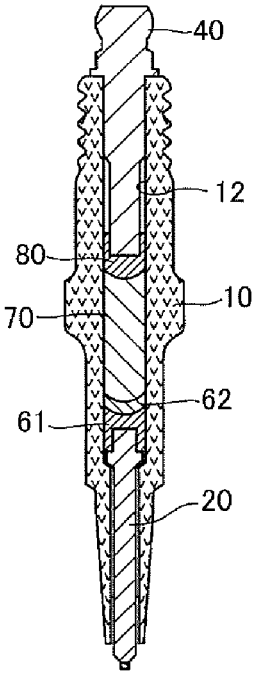
FIG.4(D)

MODIFICATION EXAMPLE

SPARK PLUG

RELATED APPLICATIONS

This application is a National Stage of International Application No. PCT/JP17/19934 filed May 29, 2017, which claims the benefit of Japanese Patent Application No. 2016-158322, filed Aug. 11, 2016, the entire contents of which are incorporated herein by reference.

FIELD OF THE INVENTION

The present invention relates to a spark plug for ignition of a fuel gas in an internal combustion engine.

BACKGROUND OF THE INVENTION

There is known a spark plug for an internal combustion engine, in which a resistor is arranged between a center electrode and a metal terminal in an axial hole of an insulator so as to suppress a radio noise caused by ignition (see, for example, Japanese Laid-Open Patent Publication No. 2003-22886).

In the axial hole of the insulator, a conductive seal layer is disposed between the resistor and the center electrode. For instance, a thermal expansion coefficient of the conductive seal layer is set to a midpoint between a thermal expansion coefficient of the insulator and a thermal expansion coefficient of the center electrode.

In recent years, there is a tendency that load exerted on the spark plug in a usage environment increases with increases in the output and temperature of the internal combustion engine. In such a severe usage environment, it is likely that a malfunction such as crack will occur at an interface of the resistor and the conductive seal layer under the action of thermal stress. This can lead to a deterioration in the durability of the spark plug.

The present description discloses a technique for improving the durability of a spark plug used in an internal combustion engine.

SUMMARY OF THE INVENTION

APPLICATION EXAMPLE 1

In accordance with a first aspect of the present invention, there is provided a spark plug comprising:

an insulator having an axial hole formed therein in an axial direction;

a center electrode extending in the axial direction and having a rear end located within the axial hole;

a metal terminal extending in the axial direction and having a front end located rearward of the rear end of the center electrode within the axial hole;

a resistor arranged between the center electrode and the metal terminal within the axial hole; and a conductive seal layer that fills a space between the resistor and the center electrode in the axial hole and keeps the center electrode and the resistor apart from each other, wherein the conductive seal layer has a first layer portion located adjacent to the center electrode and a second layer portion located between the first layer portion and the resistor, wherein a thermal expansion coefficient of the resistor, a thermal expansion coefficient of the first layer portion and a thermal expansion coefficient of the second layer portion are different from one another, and wherein the thermal expansion coefficient of the second layer portion has a value between the thermal expansion coefficient of the first layer portion and the thermal expansion coefficient of the resistor.

In the above configuration, the second layer portion whose thermal expansion coefficient has a value between the thermal expansion coefficient of the first layer portion and the thermal expansion coefficient of the resistor exists between the first layer portion and the resistor. Thus, a difference in thermal expansion coefficient between the conductive seal layer and the resistor can be decreased as compared to the case where the first layer portion is in direct contact with the resistor. It is accordingly possible to reduce thermal stress caused between the conductive seal layer and the resistor during use of the spark plug and thereby possible to improve the durability of the spark plug.

APPLICATION EXAMPLE 2

In accordance with a second aspect of the present invention, there is provided a spark plug as described above, comprising:

an insulator having an axial hole formed therein in an axial direction;

a center electrode extending in the axial direction and having a rear end located within the axial hole;

a metal terminal extending in the axial direction and having a front end located rearward of the rear end of the center electrode within the axial hole;

a resistor arranged between the center electrode and the metal terminal within the axial hole; and a conductive seal layer that fills a space between the resistor and the center electrode in the axial hole and keeps the center electrode and the resistor apart from each other, wherein the conductive seal layer has a first layer portion located adjacent to the center electrode and a second layer portion located between the first layer portion and the resistor, wherein the first layer portion contains a first conductive material, wherein the resistor contains a second conductive material different from the first conductive material, and wherein the second layer portion contains the first and second conductive materials.

In the above configuration, the second layer portion containing the first and second conductive materials exists between the first layer portion containing the first conductive material and the resistor containing the second conductive material, whereby the thermal expansion coefficient of the second layer portion is adjusted to a value between the thermal expansion coefficient of the first layer portion and the thermal expansion coefficient of the resistor. Thus, a difference in thermal expansion coefficient between the conductive seal layer and the resistor can be decreased as compared to the case where the first layer portion is in direct contact with the resistor. It is accordingly possible to reduce thermal stress caused between the conductive seal layer and the resistor during use of the spark plug and thereby improve the durability of the spark plug.

APPLICATION EXAMPLE 3

In accordance with a third aspect of the present invention, there is provided a spark plug as described above, wherein the second layer portion includes a plurality of particles, and wherein a maximum particle size of the particles included in the second layer portion is 180 μm or smaller.

In the above configuration, variations of thermal expansion coefficient in the second layer portion can be suppressed. It is thus possible to prevent a local increase in thermal stress between the conductive seal layer and the resistor and more effectively improve the durability of the spark plug.

APPLICATION EXAMPLE 4

In accordance with a fourth aspect of the present invention, there is provided a spark plug as described above, wherein the first layer portion includes first glass particles, wherein the resistor includes second glass particles having an average particle size larger than that of the first glass particles, and wherein the second layer portion includes third glass particles having an average particle size larger than that of the first glass particles and smaller than that of the second glass particles.

In the above configuration, the particle size of the glass particles is made smaller toward the front side so that, when the resistor and the conductive seal layer are formed by being pressed from the rear side to the front side, the pressure can easily propagate from the rear side to the front side. It is thus possible to achieve densification of the resistor and the conductive seal layer.

APPLICATION EXAMPLE 5

In accordance with a fifth aspect of the present invention, there is provided a spark plug as described above, wherein a resistance from a front end of the resistor to the center electrode is 1 kΩ, or lower.

It should be noted that the present invention can be embodied in various forms such as not only a spark plug but also an ignition device with a spark plug, an internal combustion engine having mounted thereon a spark plug, an internal combustion engine having mounted thereon an ignition device with a spark plug, a ground electrode of a spark plug, an alloy for use in an electrode of a spark plug, and the like.

BRIEF DESCRIPTION OF THE DRAWINGS

FIGS. 4(A), 4(B), 4(C) and 4(D) are schematic views showing the production of the insulator assembly.

DETAILED DESCRIPTION OF THE PREFERRED EMBODIMENTS

A. Exemplary Embodiment

A-1. Structure of Spark Plug

Figure 1:
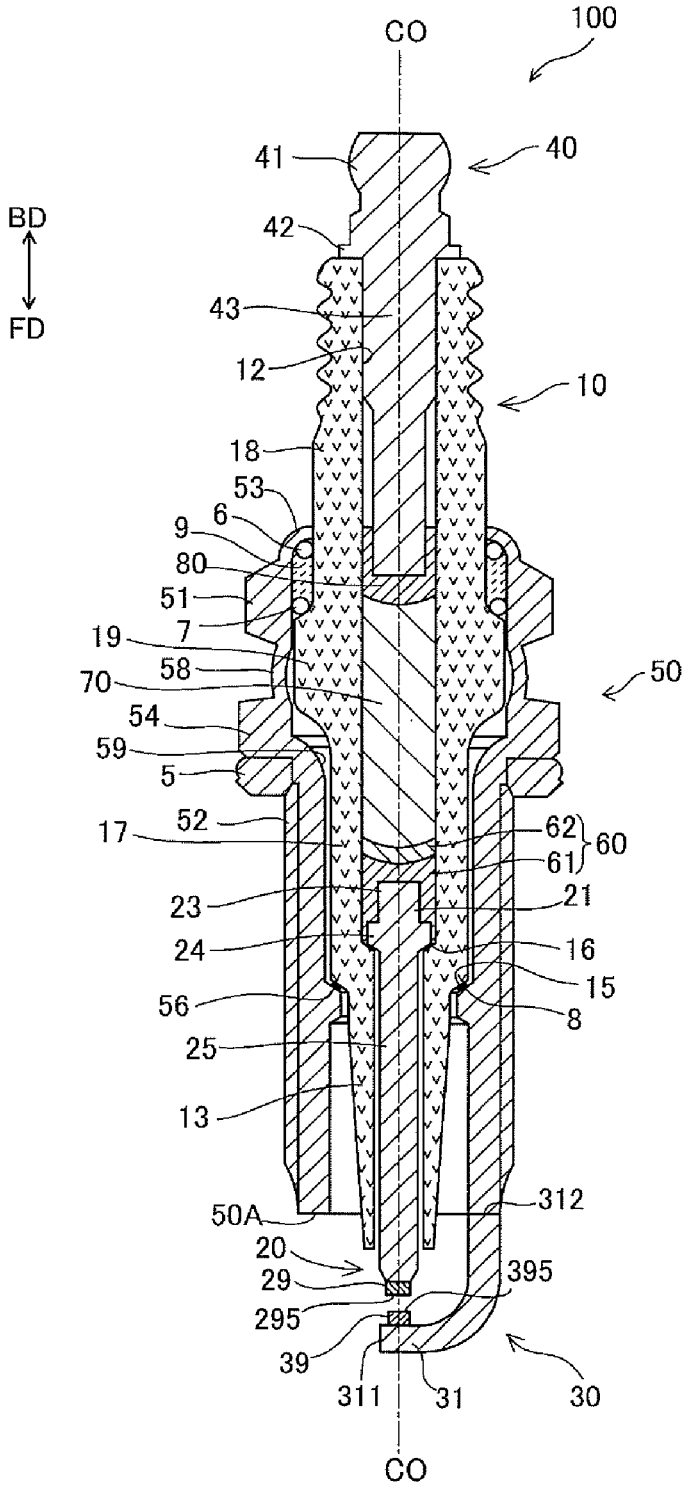
FIG. 1 is a cross-sectional view of a spark plug 100 according to an exemplary embodiment of the present invention.

FIG. 1 is a cross-sectional view of a spark plug 100 according to one exemplary embodiment of the present invention. In FIG. 1, an axis CO of the spark plug 100 is indicated by a one-dot broken line. In the present description, a direction parallel to the axis CO is also referred to as "axial direction"; a direction of the radius of a circle about the axis CO is also simply referred to as "radial direction"; and a direction of the circumference of the circle is also simply referred to as "circumferential direction". Further, a direction toward the upper side in FIG. 1 is referred to as "frontward direction FD"; and a direction toward the lower side in FIG. 1 is referred to as "rearward direction BD". The lower and upper sides in FIG. 1 are respectively referred to as front and rear sides of the spark plug 100.

The spark plug 100 is mounted to an internal combustion engine and used to ignite a combustible gas in a combustion chamber of the internal combustion engine. The spark plug 100 includes an insulator 10, a center electrode 20, a ground electrode 30, a metal terminal 40, a metal shell 50, a resistor 70 and conductive seal layers 60 and 80.

The insulator 10 is made of e.g. a ceramic material such as alumina, and has a substantially cylindrical shape with an axial hole 12 being formed therethrough along the axis. The insulator 10 includes a collar portion 19, a rear body portion 18, a front body portion 17, a step portion 15 and a leg portion 13. The collar portion 19 is located at a substantially middle part of the insulator 10 in the axial direction. The rear body portion 18 is located rearward of the collar portion 19, and has an outer diameter smaller than that of the collar portion 19. The front body portion 17 is located frontward of the collar portion 19, and has an outer diameter smaller than that of the rear body portion 18. The leg portion 13 is located frontward of the front body portion 17, and has an outer diameter smaller than that of the front body portion 17 and gradually decreasing toward the front. When the spark plug 100 is mounted to the internal combustion engine (not shown), the leg portion 13 is exposed inside the combustion chamber. The step portion 15 is provided between the leg portion 13 and the front body portion 17.

The metal shell 50 is made of a conductive metal material (e.g. low carbon steel) in a cylindrical shape and is adapted for fixing the spark plug 100 to an engine head (not shown) of the internal combustion engine. An insertion hole 59 is formed through the metal shell 50 along the axis CO. The metal shell 50 is disposed radially around (i.e. on the outer circumference of) the insulator 10. In other words, the insulator 10 is inserted and held in the insertion hole 59 of the metal shell 50. A front end of the insulator 10 protrudes toward the front from a front end of the metal shell 50, whereas a rear end of the insulator 10 protrudes toward the rear from a rear end of the metal shell 50.

The metal shell 50 includes a hexagonal column-shaped tool engagement portion 51 for engagement with a spark plug wrench, a mounting thread portion 51 for mounting to the internal combustion engine and a collar-shaped seat portion 54 provided between the tool engagement portion 51 and the mounting thread portion 52. A dimension between mutually parallel sides of the tool engagement portion 51, that is, an opposite side length of the tool engagement portion 51 is set to e.g. 9 mm to 14 mm. An outer diameter (nominal diameter) of the mounting thread portion 52 is set to e.g. 8 mm to 12 mm.

An annular gasket 5, which is formed by bending a metal plate, is fitted on a part of the metal shell 50 between the mounting thread portion 52 and the seat portion 54. When the spark plug 100 is mounted to the internal combustion engine, the gasket 5 establishes a seal between the spark plug 100 and the internal combustion engine (engine head).

The metal shell 50 further includes a thin crimp portion 53 located rearward of the tool engagement portion 51 and a thin compression deformation portion 58 located between the seat portion 54 and the tool engagement portion 51. Annular line packings 6 and 7 are disposed in an annular space between an inner circumferential surface of a part of the metal shell 50 from the tool engagement portion 51 to the crimp portion 51 and an outer circumferential surface of the rear body portion 18 of the insulator 10. A powder of talc 9 is filled between these two line packings 6 and 7 in the annular space. A rear end of the crimp portion 53 is crimped radially inwardly and fixed to the outer circumferential surface of the insulator 10. The compression deformation portion 58 is compression deformed as the crimp portion 53 is fixed to the inner circumferential surface of the insulator 10 and pushed toward the front during manufacturing of the spark plug 100. With such compression deformation of the compression deformation portion 58, the insulator 10 is pushed toward the front via the line packings 6 and 7 and the talc 9 within the metal shell 50. The step portion 15 (as an insulator-side step portion) of the insulator 10 is hence pressed against a step portion 56 (as a shell-side step portion) that is formed on the inner circumference of the metal shell 50 at a position corresponding to the mounting thread portion 52, via an annular plate packing 8 so that the plate packing 8 prevents gas leakage from the combustion chamber of the internal combustion engine through a clearance between the metal shell 50 and the insulator 10.

The center electrode 20 has a rod-shaped center electrode body 21 extending in the axial direction and a center electrode tip 29. The center electrode body 21 is held in a front side of the axial hole 12 of the insulator 10 with a rear end of the center electrode 20 (that is, a rear end of the center electrode body 21) being located within the axial hole 12. The center electrode body 21 is made of a metal material having high corrosion and heat resistance, such as nickel (Ni) or a Ni-based alloy (e.g. NCF600, NCF601). The center electrode body 21 may have a two-layer structure including an electrode base made of Ni or a Ni alloy and a core embedded in the electrode base. In this case, the core is made of copper or a copper-based alloy having a higher thermal conductivity than that of the electrode base.

The center electrode body 21 includes a collar portion 24 located at a predetermined position in the axial direction, a head portion 23 (as an electrode head portion) located rearward of the collar portion 24 and a leg portion 25 (as an electrode leg portion) located frontward of the collar portion 24. The collar portion 24 is supported on a step portion 16 that is formed in the axial hole 12 of the insulator 10. A front end of the leg portion 25, that is, a front end of the center electrode body 21 protrudes toward the front from the front end of the insulator 10.

The center electrode tip 29 is substantially cylindrical column-shaped and joined by laser welding to the front end of the center electrode body 21 (i.e. the front end of the leg portion 25). A front end surface of the center electrode tip 29 serves as a first discharge surface 295 that defines a spark gap with the after-mentioned ground electrode tip 39. The center electrode tip 29 is made of a high-melting noble metal such as iridium (Ir) or platinum (Pt) or an alloy containing such a noble metal as a main component.

The ground electrode 30 has a ground electrode body 31 and a ground electrode tip 39. The ground electrode body 31 is rod-shaped, rectangular in section, with two end surfaces: a joint end surface 312 and a free end surface 311 opposite to the joint end surface 312. The joint end surface 312 is joined by e.g. resistance welding to the front end 50A of the metal shell 50 so that the metal shell 50 and the ground electrode body 31 are electrically connected to each other. A part of the ground electrode body 31 in the vicinity of the joint end surface 312 extends in the direction of the axis O, whereas a part of the ground electrode body 31 in the vicinity of the fee end surface 311 extends in a direction perpendicular to the axis O. This rod-shaped ground electrode body 21 is bent at a middle portion thereof by about 90 degrees.

The ground electrode body 31 is made of a metal material having high corrosion and heat resistance, such as Ni or a Ni-based alloy (e.g. NCF600, NCF601). As in the case of the center electrode body 21, the ground electrode body 31 may have a two-layer structure including an electrode base and a core made of a metal material (e.g. copper) embedded in the electrode base and having a higher thermal conductivity than that of the electrode base.

The ground electrode tip 39 is cylindrical or rectangular column-shaped, and has a second discharge surface 396 opposed to and facing the first discharge surface 295 of the center electrode tip 29. A gap between the first discharge surface 295 and the second discharge surface 395 serves as a so-called spark gap in which a spark discharge occurs. As in the case of the center electrode tip 29, the ground electrode tip 39 is made of a noble metal or an alloy containing a noble metal as a main component.

The metal terminal 40 is rod-shaped in the axial direction, and is held in a rear side of the axial hole 12 of the insulator 10 with a front end of the metal terminal 40 being located rearward of the rear end of the center electrode 20 within the axial hole 12. The metal terminal 40 is made of a conductive metal material (e.g. low carbon steel). A plating layer of Ni etc. is applied to a surface of the metal terminal 40 for corrosion protection. The metal terminal 40 includes a collar portion 42 (as a terminal collar portion), a cap attachment portion 41 located rearward of the collar portion 42 and a leg portion 43 (as a terminal leg portion) located frontward of the collar portion 42. The cap attachment portion 41 of the metal terminal 40 is exposed outside from the rear end of the insulator 10. The leg portion 43 of the metal terminal 40 is inserted in the axial hole 12 of the insulator 12. A plug cap with a high-voltage cable (not shown) is attached to the cap attachment portion 41 so as to apply a high voltage for generation of a spark discharge.

The resistor 70 is arranged between the front end of the metal terminal 40 and the rear end of the center electrode 20 within the axial hole 12 of the insulator 10 and is adapted to reduce a radio noise caused at the time of generation of a spark plug. Although a detailed explanation of the resistor 70 will be given below, the resistor 70 is made of a composition containing particles of glass as a main component, particles of ceramic other than glass and a conductive material.

A space between the resistor 70 and the center electrode 20 in the axial hole 12 is filled with the conductive seal layer 60. A space between the resistor 70 and the metal terminal 40 in the axial hole 12 is filled with the conductive seal layer 80. Namely, the conductive seal layer 60 is in contact with the resistor 70 and the center electrode 20 and keeps the resistor 70 and the center electrode 20 apart from each other; and the conductive seal layer 80 is in contact with the resistor 70 and the metal terminal 40 and keeps the resistor 70 and the metal terminal 40 apart from each other. The center electrode 20 and the metal terminal 40 are hence electrically connected to each other via the resistor 70 and the conductive seal layers 60 and 80. The conductive seal layers 60 and 80 will be explained in detail below.

A-2. Vicinity of Conductive Seal Layer 60

Figure 2:
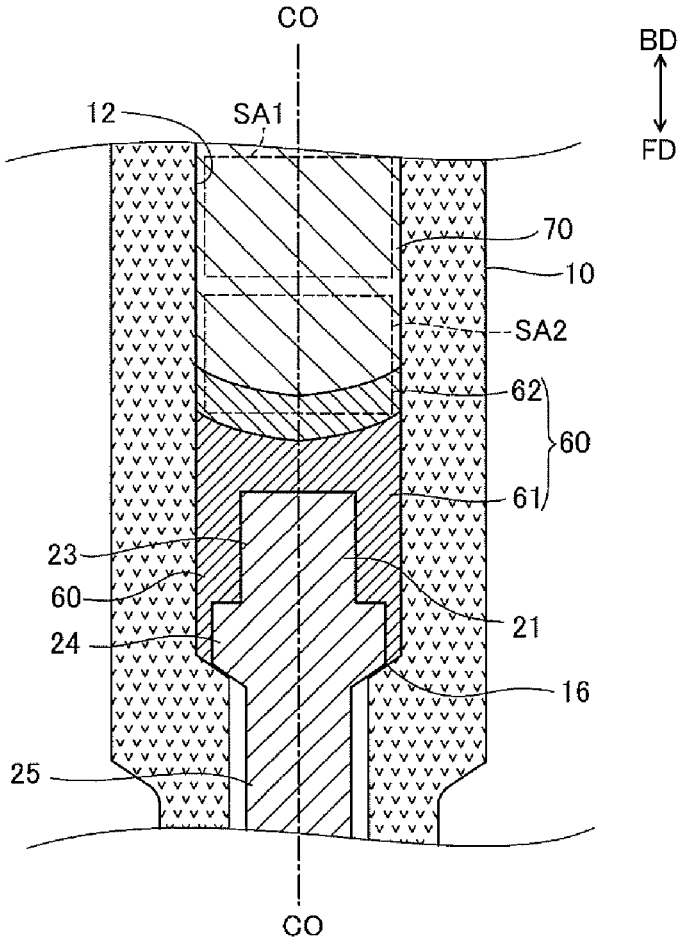
FIG. 2 is an enlargement of a part of FIG. 1 in the vicinity of a conductive seal layer 60.

FIG. 2 is an enlargement of a part of FIG. 1 in the vicinity of the conductive seal layer 60. The conductive seal layer 60 has a first layer portion 61 located adjacent to the center electrode 20 and a second layer portion 62 located between the first layer portion 61 and the resistor 70. The first layer portion 61 is in contact with a part of the center electrode 20 including its rear end and, more specifically, in contact with the head portion 23 and the collar portion 24. The first layer portion 61 is however not in contact with the resistor 70. The second layer portion 62 is in contact with the first layer portion 61 and a part of the resistor 70 including its front end. The average of the length of the second layer portion 62 in the axial direction (i.e. average thickness) is preferably 0.5 mm or larger, more preferably 1 mm or larger.

The conductive seal layer 60 is sufficiently lower in resistance than the resistor 70. The resistance of the resistor 70 is higher than 1 kΩ and is set to e.g. 5 kΩ or 10 kΩ. The resistance of the conductive seal layer 60, that is, the resistance from the front end of the resistor 70 to the rear end of the center electrode 20 is 1 kΩ or lower, preferably 1Ω or lower, and is set to e.g. 50 mmΩ to 500 mmΩ.

The resistor 60, the first layer portion 61 and the second layer portion 62 are different from one another in thermal expansion coefficient (linear expansion coefficient). By repeated cooling and heating cycles during use of the spark plug 100, there occur thermal stress on a contact surface of two mutually contacted structural parts due to a difference in thermal expansion coefficient between these two structural parts. This thermal stress can cause a malfunction such as crack between the two structural parts to deteriorate adhesion of the two structural parts. In order to avoid such a malfunction, the thermal expansion coefficients of the resistor 70, the first layer portion 61 and the second layer portion 62 are determined as follows in the present embodiment.

When the adhesion of the resistor 70 and the insulator 10 is deteriorated due to the occurrence of thermal stress on a contact surface between the resistor 70 and the insulator 10, the electrical resistance of the contact surface may become lower than the electrical resistance of the resistor 70. In this case, the function of the resistor 70 is impaired. It is therefore preferable that the thermal expansion coefficient of the resistor 70 is set to a value close to the thermal expansion coefficient of the insulator 10 in order to reduce thermal stress caused between the resistor 70 and the insulator 10.

When the adhesion of the first layer portion 61 and the center electrode body 21 is deteriorated due to the occurrence of thermal stress on a contact surface between the first layer portion 61 and the center electrode body 21, the electrical resistance of the contact surface may be changed as compared to the case where the adhesion is good. In this case, there is a possibility that the spark plug 100 cannot exert its desired performance. It is therefore preferable that the thermal expansion coefficient of the first layer portion 61 is set to a value close to the thermal expansion coefficient (e.g. about $12\times10^{-6}$ to $13\times10^{-6}$/° C.) of the center electrode body 21 in order to reduce thermal stress caused between the first layer portion 61 and the center electrode body 21.

When the adhesion of the second layer portion 62 with the resistor 70 and/or the first layer portion 61 is deteriorated due to the occurrence of thermal stress on a contact surface between the second layer portion 62 and the resistor 70 and a contact surface between the second layer portion 62 and the first layer portion 61, the electrical resistance of the contact surface may be changed as compared to the case where the adhesion is good. In this case, there is a possibility that the spark plug 100 cannot exert its desired performance. Accordingly, the thermal expansion coefficient of the second layer portion 62 is set to a value between the thermal expansion coefficient of the first layer portion 61 and the thermal expansion coefficient of the resistor 70 in the present embodiment in order to reduce thermal stress caused between the second layer portion 62 and the first layer portion 61 and between the second layer portion 62 and the resistor 70.

The ceramic insulator 10 has a thermal expansion coefficient (e.g. about $5\times10^{-6}$ to $7\times10^{-6}$/° C.) lower than the thermal expansion coefficient (e.g. about $12\times10^{-6}$ to $13\times10^{-6}$/° C.) of the metallic center electrode body 21. The thermal expansion coefficient of the resistor 70 is hence lower than the thermal expansion coefficient of the first layer portion 61. Therefore, the thermal expansion coefficient ascends in the order of the resistor 70, the second layer portion 62 and the first layer portion 61.

In the present embodiment, the resistor 70, the first layer portion 61 and the second layer portion 62 are formed using the following materials.

Resistor 70: a mixture of carbon black, $TiO_2$, $ZrO_2$, aluminum and glass.

First layer portion 61: a mixture of brass (Cu—Zn alloy) and glass.

Second layer portion 62: a mixture of brass, carbon black, $TiO_2$, $ZrO_2$, aluminum and glass.

The higher the mixing ratio of the metal material (such as aluminum and brass) which is higher in thermal expansion coefficient than the ceramic material (such as $TiO_2$ and $ZrO_2$) and the glass material, the higher the thermal expansion coefficient of the structural part. The lower the mixing ratio of the metal material, the lower the thermal expansion coefficient of the structural part. In the present embodiment, the thermal expansion coefficients of the resistor 70, the first layer portion 61 and the second layer portion 62 are adjusted as follows.

Resistor 70: $5.7\times10^{-6}$/° C.

First layer portion 61: $12\times10^{-6}$/° C.

Second layer portion 62: $7.2\times10^{-6}$/° C.

Among the above raw materials, carbon black, aluminum and brass are conductive materials having electrical conductivity; whereas $TiO_2$, $ZrO_2$ and glass are insulating materials having no electrical conductivity. As the glass, for example, there can be used $B_2O_3$—$SiO_2$ glass.

The first and second layer portions 61 and 62 are respectively formed by mixing of particles of the above materials. A maximum particle size Rmax of the particles included in the second layer portion 62 is 180 μm or smaller and is set to e.g. 100 μm.

In the present embodiment, the glass particles included in the first layer portion 61 has an average particle size R61 of 100 μm; the glass particles included in the second layer portion 62 has an average particle size R62 of 150 μm; and the glass particles included in the resistor 70 has an average particle size R70 of 300 μm. In this way, the average particle sizes R61, R62 and R70 of the glass particles satisfy the relationship of R61<R62<R70 in the present embodiment. Namely, the average particle size of the glass particles included in the resistor 70 is larger than the average particle size of the glass particles included in the first layer portion 61; and the average particle size of the glass particles included in the second layer portion 62 is larger than the average particle size of the glass particles included in the first layer portion 61 and smaller than the average particle size of the glass particles included in the resistor 70.

The rear conductive seal layer 80 can be formed e.g. using the same material as that of the first layer portion 61 of the conductive seal layer 60 with the same particle size as that of the first layer portion 61.

A-3. Methods for Measurements of Thermal Expansion Coefficient and Particle Size The thermal expansion coefficient of each structural part is measured by a known TMA (Thermal Mechanical Analysis) method, which is a technique for analyzing temperature-dependent mechanical characteristics including a thermal expansion coefficient. More specifically, the thermal expansion coefficient of each structural part is measured according to "Testing Method for Average Linear Thermal Expansion of Glass" as specified in JIS R 3102. Since the second layer portion 62 is relatively small in thickness, there is a case that it is difficult to directly measure the thermal expansion coefficient of the second layer portion 62 itself. In this case, the thermal expansion coefficient of the second layer portion 62 can be measured by e.g. the following method. First, the thermal expansion coefficient of a sample of region SA1 shown in FIG. 2 (that is, a sample including only the resistor 70) is determined as the thermal expansion coefficient of the resistor 70. Then, the thermal expansion coefficient of a sample of region SA2 shown in FIG. 2 (that is, a sample including the resistor 70 and the second layer portion 62) is determined. Based on the measurement results of these two region samples, the thermal expansion coefficient of the second layer portion 62 itself is determined.

The maximum particle size Rmax of the particles included in each structural part is measured by the following method. First, a cross section of the measurement target structural part including the axis O is subjected to grinding such that grain boundaries can be seen on the cross section. Next, a SEM image of the cross section is taken with a scanning electron microscope (SEM). By changing the magnification of the SEM image arbitrarily according to the size of observed crystal grains, a view field range in which at least 50 particles are observable is set on the SEM image. A maximum value among the measured particle sizes is determined as the maximum particle size Rmax. Herein, the particle size measurement is performed on a sufficiently large number of particles in view of variations in the particle sizes of the observed particles. In the case where the variations in the particle sizes of the observed particles are large, for example, it is conceivable to take a plurality of SEM images at different sites and thereby increase the number of measurement target particles as appropriate.

The average particle size R61, R62, R70 of the glass particles included in each structural part is measured by the following method. A SEM image of a cross section of the measurement target structural part including the axis CO is taken with a scanning electron microscope (SEM) in the same manner as mentioned above. Then, a view field range in which at least 50 glass particles are observable is set on the SEM image in the same manner as mentioned above. The glass particles are identified on the SEM image by componential analysis with an EPMA (Electron Probe Micro Analyzer). A straight line is arbitrarily drawn on the SEM image. The particle sizes of the respective glass particles over which the straight line crosses are measured. The total sum of the measured particle sizes is calculated. The average particle size is determined based on the total sum of the measured particle sizes and the number of measurement target glass particles.

A-4. Method for Manufacturing of Spark Plug

The above-mentioned spark plug 100 can be manufactured by, for example, the following method. An insulator assembly (in which the center electrode 20, the metal terminal 40, the resistor 70, the conductive seal layers 60 and 80 and the like are assembled and fitted in the insulator 10) is produced by the after-mentioned process. The metal shell 50 and the ground electrode 30 are also produced. The metal shell 50 is fixed on the outer circumference of the insulator assembly. The joint end surface 312 of the ground electrode 30 is joined to the front end 50A of the metal shell 50. The ground electrode tip 39 is then welded to the part of the joined ground electrode 30 in the vicinity of the free end surface 311. After that, the ground electrode 30 is bent such that the ground electrode tip 39 of the ground electrode 30 is opposed to and faces the center electrode tip 29 of the center electrode 20. With this, the spark plug 100 is completed.

Figure 3:
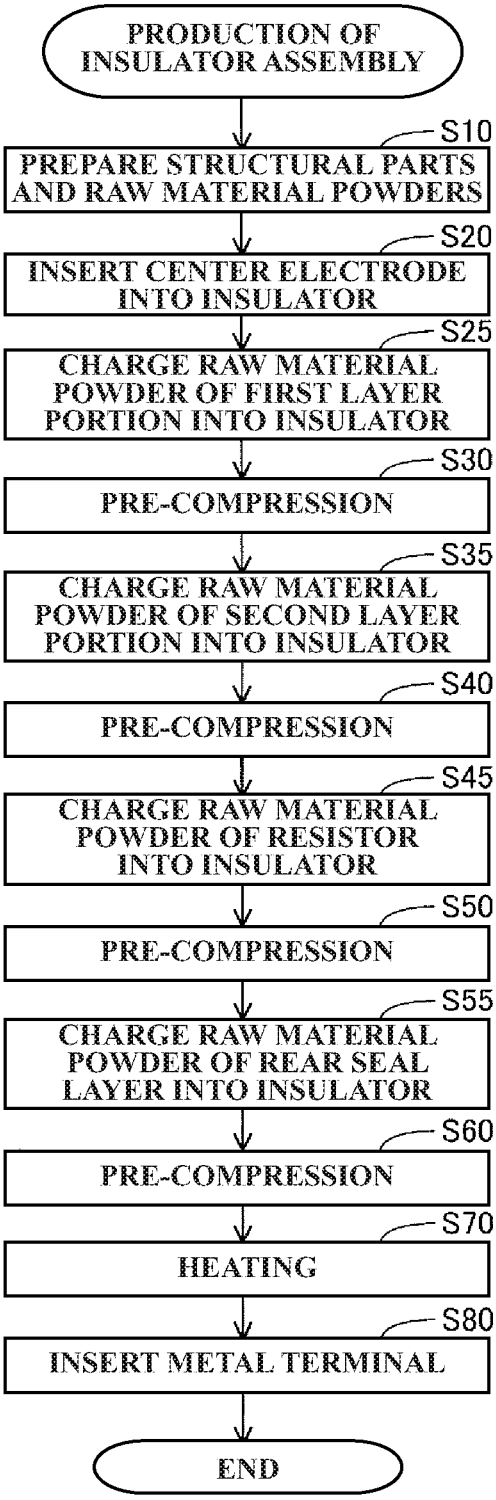
FIG. 3 is a flowchart for production of an insulator assembly.

The production process of the insulator assembly will be now explained below with reference to FIGS. 3 and 4. FIG. 3 is a flowchart for the production process of the insulator assembly. FIG. 4 is a schematic view showing the production process of the insulator assembly.

In step S1, the required structural parts raw material powders are prepared. More specifically, the insulator 10, the center electrode 20 with the center electrode tip 20 joined to the front end thereof, and the metal terminal 40 are prepared. Further, the respective raw material powders 65, 68, 85 and 75 of the front conductive seal layer 60 (first and second layer portions 61 and 62), the rear conductive seal layer 80 and the resistor 70 are prepared.

The respective raw material powders are obtained by mixing particles of the above-mentioned raw materials. Further, the particles sizes of the respective raw material powders are adjusted to the above-mentioned particle size values.

In step S2, the center electrode 20 is inserted into the axial hole 12 of the insulator 10 from its rear opening. As mentioned above with reference to FIG. 2, the center electrode 20 is fixed in the axial hole 12 by being supported on the step portion 16 of the insulator 10 (see FIG. 4(A)).

In step S25, the raw material powder 65 of the first layer portion 61 is charged into the axial hole 12 of the insulator 10 from its rear opening, that is, from above the center electrode 20 (see FIG. 4(A)).

In step S30, the raw material powder 65 charged into the axial hole 12 is subjected to pre-compression. Herein, the pre-compression is done by compressing the raw material powder 65 with the use of a compression rod member 200 (see FIG. 4(A)).

In step S35, the raw material powder 68 of the second layer portion 62 is charged into the axial hole 12 of the insulator 10 from its rear opening, that is, from above the raw material powder 65.

In step S40, the raw material powder 68 charged into the axial hole 12 is subjected to pre-compression in the same manner as above in step S30.

In step S45, the raw material powder 75 of the resistor 70 is charged into the axial hole 12 of the insulator 10 from its rear opening, that is, from above the raw material power 68.

In step S50, the raw material powder 75 charged into the axial hole 12 is subjected to pre-compression in the same manner as above in step S30.

In step S55, the raw material powder 85 of the conductive seal layer 80 is charged into the axial hole 12 of the insulator 10 from its rear opening, that is, from above the raw material powder 75.

In step S60, the raw material powder 85 charged into the axial hole 12 is subjected to pre-compression in the same manner as above in step S30.

In FIG. 4(B), the insulator 10 as well as the center electrode 20 and the raw material powders 65, 68, 75 and 85 inserted/charged into the axial hole 12 of the insulator 10 at the time of completion of the process up to step S60 are shown.

In step S70, the insulator 10 in this state is transferred into a furnace and heated to a predetermined temperature. The predetermined temperature is set to e.g. a temperature higher than softening points of the glass components contained in the raw material powders 65, 68, 75 and 85. More specifically, the predetermined temperature is set to 800 to 950° C.

In step S80, the metal terminal 40 is inserted into the axial hole 12 of the insulator 10 from its rear opening (see FIG. 4(C)) in the state that the insulator 10 is being heated to the predetermined temperature. Then, the respective raw material powders 65, 68, 75 and 85 stacked in layers in the axial hole 12 of the insulator 10 are pressed (compressed) in the axial direction by the front end of the metal terminal 40. The respective raw material powders 65, 68, 75 and 85 are consequently compressed and sintered, thereby forming the above-mentioned first layer portion 61, second layer portion 62, resistor 70 and conductive seal layer 80 as shown in FIG. 4(D). The insulator assembly is completed through the above process steps.

As described above, the second layer portion 62 exists between the first layer portion 61 and the resistor 70 and has a thermal expansion coefficient between those of the first layer portion 61 and the resistor 70 in the present embodiment. Thus, a difference in thermal expansion coefficient between the conductive seal layer 60 and the resistor 70 can be decreased as compared to the case where the first layer portion 61 is in direct contact with the resistor 70. It is accordingly possible to reduce thermal stress caused between the conductive seal layer 60 and the resistor 70 during use of the spark plug 100 and thereby possible to improve the durability of the spark plug.

For example, when a crack occurs between the conductive seal layer 60 and the resistor 70 due to thermal stress caused between the conductive seal layer 60 and the resistor 70, the resistance between the center electrode 20 and the metal terminal 40 may be changed. Further, a phenomenon of material degradation may occur by melting of the conductive seal layer 60 and the resistor 70 due to generation of a spark in the crack. In these cases, there is a possibility that the spark plug 100 cannot exert its desired performance. This malfunction is however avoided in the present embodiment.

Further, the first layer portion 61 contains brass as a conductive material; the resistor 70 contains carbon black and aluminum as a conductive material; and the second layer portion 62, which exists between the first layer portion 61 and the resistor 70, contains both of brass contained in the first layer portion 61 and carbon black and aluminum contained in the resistor 70. As a result, the thermal expansion coefficient of the second layer portion 62 is controlled to a value between the thermal expansion coefficient of the first layer portion 61 and the thermal expansion coefficient of the resistor 70. Thus, a difference in thermal expansion coefficient between the conductive seal layer 60 and the resistor 70 can be decreased as compared to the case where the first layer portion 61 is in direct contact with the resistor 70. It is accordingly possible to reduce thermal stress caused between the conductive seal layer 60 and the resistor 70 during use of the spark plug 100 and thereby improve the durability of the spark plug 100. Since the same conductive material is contained in the mutually contacted structural parts, the adhesion of the first layer portion 61 and the second layer portion 62 and the adhesion of the second layer portion 62 and the resistor 70 is increased. It is thus possible to stabilize the resistance between the center electrode 20 and the metal terminal 40.

Furthermore, the maximum particle size Rmax of the particles included in the second layer portion 62 is preferably set to 180 μm or smaller. By this particle size control, the relatively high thermal expansion coefficient particles (e.g. brass, aluminum) and the relatively low thermal expansion coefficient particles (e.g. $TiO_2$, $ZrO_2$, glass) exist relatively uniformly in the second layer portion 62 as compared to the case where the maximum particle size Rmax is larger than 180 μm. In consequence, variations of thermal expansion coefficient in the second layer portion 62 can be suppressed so as to prevent a local increase in terminal resistance between the conductive seal layer 60 (second layer portion 62) and the resistor 70 and between the first layer portion 61 and the second layer portion 62. It is thus possible to further improve the durability of the spark plug 100.

Similarly, the maximum particle sizes of the particles included in the first layer portion 61 and in the resistor 70 are preferably set to 180 μm or smaller. By this particle size control, variations of thermal expansion coefficient in the first layer portion 61 and in the resistor 70 can also be suppressed so as to prevent a local increase in terminal resistance between the second layer portion 62 and the resistor 70 and between the first layer portion 61 and the second layer portion 62.

Moreover, the average particle size of the glass particles included in the resistor 70 is larger than that of the glass particles included in the first layer portion 61; and the average particle size of the glass particles included in the second layer portion 62 is larger than that of the glass particles included in the first layer portion 61 and smaller than that of the glass particles included in the resistor 70. Consequently, the particle size of the glass particles decreases toward the front side. The smaller the particle size of the glass particles, the easier the glass particles are to soften in step S3 of FIG. 3. The larger the particle size of the glass particles, the more likely the hard portions are to remain, the more difficult the glass particles as a whole are to soften. When the resistor 70 and the conductive seal layer 60 are formed by being pressed by the metal terminal 40 from the rear side to the front side in step S80 of FIG. 3, the relatively hard layer portion is situated in a rearward position; and the softer layer portion is situated in a more frontward position. In such a state, the pressure can easily propagate from the rear side to the front side in step S80 of FIG. 3. It is thus possible to achieve densification of the resistor 70 and the conductive seal layer 60.

In the case where the average thickness of the second layer portion 62 is excessively small, thermal stress between the resistor 70 and the conductive seal layer 60 may not be sufficiently suppressed. In the present embodiment, the average thickness of the second layer portion 62 is hence preferably set to 0.5 mm or larger so as to appropriately suppress thermal stress between the resistor 70 and the conductive seal layer 60.

As is clear from the above explanations, carbon black and aluminum are examples of the first conductive material; and brass is an example of the second conductive material.

Figure 5:
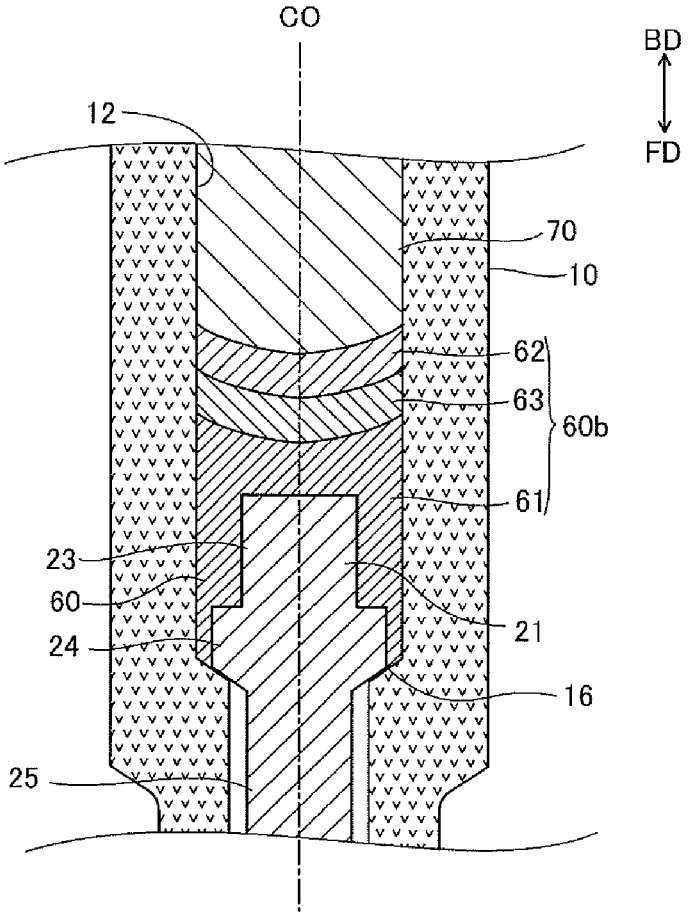
FIG. 5 is an enlarged cross-sectional view of a part of spark plug in the vicinity of a conductive seal member 60*b* according to a modification example of the present invention.

B. Modification Examples (1) The structure of the conductive seal layer 60 is not limited to the above-mentioned two-layer structure. The conductive seal layer 60 may have a multilayer structure of more than two layer portions. FIG. 5 is an enlarged cross-sectional view of a part of a spark plug in the vicinity of a conductive seal layer 60*b* according to one modification example of the present invention. The conductive seal layer 60*b* of FIG. 5 has a three-layer structure including, in addition to the first and second layer portions 61 and 62 of FIG. 2, a third layer portion 63 located between these first and second layer portions 61 and 62. In this case, it is preferable that the thermal expansion coefficient of the third layer portion 63 is set to a value between the thermal expansion coefficient of the first layer portion 61 and the thermal expansion coefficient of the second layer portion 62. For example, the thermal expansion coefficient preferably ascends in the order of the resistor 70, the second layer portion 62 and the first layer portion 61 such that the thermal expansion coefficient increases in a stepwise manner from the second electrode 20 side (front side) toward the resistor 70 side (rear side).

(2) The materials of the first layer portion 61, the second layer portion 62 and the resistor 70 in the above embodiment are mere examples. Various other materials are also usable.

For example, any other metal material (such as Cu, Fe, Sb, Sn, Ag, Al or an alloy thereof) or carbon material can be used in combination with or in place of brass as the conductive material in the first layer portion 61.

In the resistor 70, a metal (such as Ni, Cu or the like), perovskite oxide (such as $SrTiO_3$, $SrCrO_3$ or the like) or carbon compound (such as $Cr_3C_2$, TiC or the like) can be used in combination with or in place of carbon black and aluminum as the conductive material.

Further, all or part of the above-mentioned conductive materials usable in the first layer portion 61 and the resistor 70 can be used in combination with or in place of brass, carbon black and aluminum as the conductive material in the second layer portion 62.

As the glass particles included in the first layer portion 61, the second layer portion 62 and the resistor 70, there can be used various glass particles containing at least one component selected from $SiO_2$, $B_2O_3$, BaO, $P_2O_5$, $Li_2O$, $Al_2O_3$ and CaO.

The components of the first layer portion 61, the second layer portion 62 and the resistor 70 are not limited to spherical particle forms and can alternatively be in fibrous or foil-like particle form such as metal foil, carbon fiber or the like.

(3) In the above embodiment, the thermal expansion coefficient of the second layer portion 62 is controlled to a value between the thermal expansion coefficient of the first layer portion 61 and the thermal expansion coefficient of the resistor 70 by containing, in the second layer portion 62, both of the conductive material (brass) contained in the first layer portion 61 and the conductive material (carbon black and aluminum) contained in the resistor 70. Alternatively, the thermal expansion coefficient of the second layer portion 62 may be controlled to a value between the thermal expansion coefficient of the first layer portion 61 and the thermal expansion coefficient of the resistor 70 by containing, in the second layer portion 62, a different material whose thermal expansion coefficient has a value between the thermal expansion coefficient of the conductive material or glass material contained in the first layer portion 61 and the thermal expansion coefficient of the conductive material or glass material contained in the resistor 70.

(4) The particle sizes of the particles included in the first layer portion 61, the second layer portion 62 and the resistor 70 may be different from those of the above embodiment. For example, the maximum particle size of the particles included in the second layer portion 62 may be larger than 180 μm. The average particle size of the glass particles included in the first layer portion 61 may be larger than the average particle sizes of the glass particles included in the second layer portion 62 and the resistor 70, or may be the same as the average particle sizes of the glass particles included in the second layer portion 62 and the resistor 70.

(5) The specific configuration of the spark plug 100 in the above embodiment is merely one example. Any other configuration is applicable to the spark plug. For example, the ignition part of the spark plug can be in various forms. The spark plug may be of the type in which the ground electrode and the center electrode 20 are opposed to each other in a direction perpendicular to the axis with a gap defined therebetween. The materials of the insulator 10 and the metal terminal 40 are not limited to the above-mentioned materials. For example, the insulator 10 can be made of a ceramic material containing another compound (such as AN, $ZrO_2$, SiC, $TiO_2$, $Y_2O_3$ or the like) as a main component in place of the alumina ($Al_2O_3$)-based ceramic material.

Although the present invention has been described with reference to the above embodiment and modification examples, the above embodiment and modification examples are not intended to limit the present invention thereto. Various changes and modifications can be made to the above embodiment and modification examples without departing from the scope of the present invention.

DESCRIPTION OF REFERENCE NUMERALS

5: Gasket
6: Line packing
8: Plate packing
9: Talc
10: Insulator
12: Axial hole
13: Leg portion
15: Step portion
16: Step portion
17: Front body portion
18: Rear body portion
19: Collar portion
20: Center electrode
21: Center electrode body
23: Head portion
24: Collar portion
25: Leg portion
29: Center electrode tip
30: Ground electrode
31: Ground electrode body
39: Ground electrode tip
40: Metal terminal
41: Cap attachment portion
42: Collar portion
43: Leg portion
50: Metal shell
50A: Front end
51: Tool engagement portion
52: Mounting thread portion
53: Crimp portion
54: Seat portion
56: Step portion
58: Compression deformation portion

59: Insertion hole
60, 60*b*, 80: Conductive seal layer
61: First layer portion
62: Second layer portion
63: Third layer portion
65, 68, 75, 85: Raw material powder
70: Resistor
100: Spark plug
200: Compression rod
295: First discharge surface
395: Second discharge surface Having described the invention, the following is claimed:

1. A spark plug comprising:

an insulator having an axial hole formed therein in an axial direction;

a center electrode extending in the axial direction and having a rear end located within the axial hole;

a metal terminal extending in the axial direction and having a front end located rearward of the rear end of the center electrode within the axial hole;

a resistor arranged between the center electrode and the metal terminal within the axial hole; and a conductive seal layer that fills a space between the resistor and the center electrode in the axial hole and keeps the center electrode and the resistor apart from each other, wherein the conductive seal layer has a first layer portion located adjacent to the center electrode and a second layer portion located between the first layer portion and the resistor, wherein a thermal expansion coefficient of the resistor, a thermal expansion coefficient of the first layer portion and a thermal expansion coefficient of the second layer portion are different from one another, and wherein the thermal expansion coefficient of the second layer portion has a value between the thermal expansion coefficient of the first layer portion and the thermal expansion coefficient of the resistor.

2. The spark plug according to claim 1, wherein the second layer portion includes a plurality of particles, and wherein a maximum particle size of the particles included in the second layer portion is 180 μm or smaller.

3. The spark plug according to claim 1, wherein the first layer portion contains a first conductive material, wherein the resistor contains a second conductive material different from the first conductive material, and wherein the second layer portion contains the first and second conductive materials.

4. The spark plug according to claim 1, wherein the first layer portion includes first glass particles, wherein the resistor includes second glass particles having an average particle size larger than that of the first glass particles, and wherein the second layer portion includes third glass particles having an average particle size larger than that of the first glass particles and smaller than that of the second glass particles.

5. The spark plug according to claim 1, wherein a resistance of the conductive seal layer between a front end of the resistor and the rear end of the center electrode is 1 kΩ or lower.

6. A spark plug comprising:

an insulator having an axial hole formed therein in an axial direction;

a center electrode extending in the axial direction and having a rear end located within the axial hole;

a metal terminal extending in the axial direction and having a front end located rearward of the rear end portion of the center electrode within the axial hole;

a resistor arranged between the center electrode and the metal terminal within the axial hole; and a conductive seal layer that fills a space between the resistor and the center electrode in the axial hole and keeps the center electrode and the resistor apart from each other, wherein the conductive seal layer has a first layer portion located adjacent to the center electrode and a second layer portion located between the first layer portion and the resistor, wherein the first layer portion contains a first conductive material, wherein the resistor contains a second conductive material different from the first conductive material, wherein the second layer portion contains the first and second conductive materials, wherein the first layer portion includes first glass particles, wherein the resistor includes second glass particles having an average particle size larger than that of the first glass particles, and wherein the second layer portion includes third glass particles having an average particle size larger than that of the first glass particles and smaller than that of the second glass particles.

7. The spark plug according to claim 6, wherein the second layer portion includes a plurality of particles, and wherein a maximum particle size of the particles included in the second layer portion is 180 μm or smaller.

8. The spark plug according to claim 6, wherein a resistance of the conductive seal layer between a front end of the resistor and the rear end of the center electrode is 1 kΩ or lower.

* * * * *